United States Patent [19]

Davis

[11] Patent Number: 4,651,835

[45] Date of Patent: Mar. 24, 1987

[54] CORE CATCHER FOR USE WITH AN HYDRAULICALLY DISPLACED INNER TUBE IN A CORING TOOL

[75] Inventor: John S. Davis, Sandy, Utah

[73] Assignee: Eastman Christensen Company, Salt Lake City, Utah

[21] Appl. No.: 655,769

[22] Filed: Oct. 1, 1984

[51] Int. Cl.[4] ..... E21B 25/00

[52] U.S. Cl. ..... 175/58; 175/250; 175/403

[58] Field of Search ..... 175/58, 249, 250, 251, 175/403, 404, 405; 403/371, 374

[56] References Cited

U.S. PATENT DOCUMENTS

| | | | |
|---|---|---|---|
| 2,747,841 | 5/1956 | Adamson et al. | 175/250 X |
| 2,893,691 | 7/1959 | Johnson | 175/250 X |
| 3,540,537 | 11/1970 | Brown | 175/251 |
| 3,578,093 | 5/1971 | Elenburg | 175/249 X |
| 3,854,768 | 12/1974 | King, Sr. | 403/371 X |
| 4,479,557 | 10/1984 | Park et al. | 175/249 X |

*Primary Examiner*—Stuart S. Levy
*Assistant Examiner*—David Werner
*Attorney, Agent, or Firm*—Beehler, Pavitt, Siegemund, Jagger, Martella & Dawes

[57] ABSTRACT

An improved core catcher for use within a coring tool is provided by shaping the lower portion of the core catcher so as to form a collapsible lower section. The collapsible lower section is structurally collapsed as the core catcher is longitudinally displaced within the coring tool to exert a radially compressive force against the core and to thereby seize the core and retain it within the coring tool. In one embodiment, the collapsible lower section is resilient so that it collapses and after operation resumes its original configuration for reuse. In another embodiment, the collapsible lower section is crushable and is therefore not reusable after the first use. The reusable core catcher is devised by providing the lower section of the core catcher with a plurality of thin slots appropriately aligned and extending through the lower section of the core catcher. The nonreusable core catcher is designed to provide a plurality of crushable longitudinal segments of the lower section of the core catcher, and in one embodiment to allow the entire lower section of the core catcher to be crushable.

15 Claims, 5 Drawing Figures

CORE CATCHER FOR USE WITH AN HYDRAULICALLY DISPLACED INNER TUBE IN A CORING TOOL

BACKGROUND OF THE INVENTION

1. FIELD OF THE INVENTION

The present invention relates to the field of earth boring tools, and more particularly to core catchers used in coring tools for catching or retaining a cut core.

2. DESCRIPTION OF THE PRIOR ART

The primary means for positively determining the nature of the rock formation which is being cut in a petroluem drilling operation remains cutting and retrieving an actual core cut from the formation. Traditionally, a core is cut using a coring bit which is a toroidally shaped bit having a cylindrical inner gage. Therefore, a cylindrical core is generally cut from the rock formation by the coring bit which is coupled to a drill collar. The core is then disposed within a coring tool as the coring bit continues to drill into the rock formation. Since hydraulic fluid is being forced downwardly within the drill string and collar to provide a cooling and cleaning action across the coring bit face, the core is isolated within the coring tool by being disposed within an inner barrel or tube. In addition thereto, the out core may be placed within a plastic sleeve within the inner barrel in order to facilitate removal of the core from the inner barrel and transportation of the core after retrieval from the bore hole. In order to successfully cut the core, it must of course easily slip fit through the core bit and into the inner barrel and sleeve. By the same token, once cut from the rock formation, the core, unless jammed within the core barrel, will just as easily slip out. In addition, some means is required in order to seize the core in order to break it from the formation from which, if in a consolidated rock formation, it integrally extends.

In response to this problem, the prior art devised a meas for gripping and retaining the core within the core barrel, namely a core catcher. In its most basic sense, prior art core catchers are comprised of cylindrical segments disposed within the coring tool and typically bearing against the inside surface of the coring bit or shoe. The inside surface of the coring bit or shoe, and the outside surface of the core catcher, are typically inclined with respect to the longitudinal axis of the drill string and coring bit. Thus, the surface upon which the core catcher rides is generally defined by the inside surface of a frustoconical shape. Two prior art methods are used to create a jamming force to prevent the core from leaving the core barrel. In the most common method, a split cylindrical catcher is designed to have an interference fit with the core, allowing the core to pass through the catcher by opening it slightly. Upward movement of the catcher is limited by the design, and downward movement causes a wedging of the core catcher against the core which will permit core breakage and retrieval. The other method uses gravity to initiate the wedging.

In the first method, i.e., split ring, the interference required to make the catcher first expand around and seize the core is a major cause of core blockage, especially when fractured formations are cut. Core blockage prevents the core from entering the barrel, causing the coring opertion to be terminated.

In the second method, i.e., gravity actuated core catchers, as highly deviated holes and horizontal drilling becomes more common, it is becoming increasingly necessary to not rely on gravity to initiate the wedging action.

Therefore, what is needed is some means by which a core catcher can be devised which will reliably and uniformly apply a grasping and retaining force to a consolidated core.

BRIEF SUMMARY OF THE INVENTION

The present invention is an improvement in a coring tool having a longitudinal axis, including a core catcher. The improvement comprises an upper section of the core catcher, and a lower section of the core catcher connected to and extending from the upper section. The lower section is configured to collapse inwardly towards the longitudinal axis of the coring tool as the core catcher is longitudinally displaced within the coring tool. By reason of this combination of elements, a substantially uniform compressive force is exerted by the core catcher against a core disposed within the coring tool.

More particularly, the mechanism which allows the lower section of the core catcher to collapse comprises a plurality of tines defined in the lower section. Each tine has a tapered thickness beginning with a maximal radial thickness at a first predetermined longitudinal point on the lower section of the core catcher, which thickness decreases to a minimal thickness at a lowermost end of the lower section of the core catcher. The mechanism further comprises a corresponding adjacent tapered surface within the coring tool. The tines and adjacent surface have a surface of mutual contact describing a frustoconical shape of decreasing diameter to the lowermost end of the lower section of the core catcher.

In one embodiment the improvement comprises a plurality of tines defined in the lower section of the core catcher by a corresponding plurality of thin radially extending slots defined through the lower section of the core catcher, and extending from the lowermost end of the lower section of the core catcher to the upper section of the core catcher. In another embodiment the slots are not radial, but are inclined or disposed along a cord of the cylindrical core catcher. In yet another embodiment, the lower section is integral with the upper section and is collapsible. The collapsible lower section is comprised of a crushable wall, and in one embodiment the crushable wall is comprised of a plurality of longitudinally extending ribs innerconnected by a thin web. In one version of this last embodiment, the ribs are solid and substantially non-crushable, while in another version the ribs are hollow and crushable.

The invention further comprises a method for retaining the core within a coring tool comprising the steps of cutting the core and disposing the core within the coring tool. The core catcher is then positively or hydraulically longitudinally displaced within the coring tool without dependence upon gravity and without dependence upon any interference fit between the core and the core catcher. The core catcher is then structurally collapsed by the positive longitudinal displacement of the core catcher within the coring tool, thereby resulting in the exertion of a radially compressive force against the core.

The invention and its various embodiments are better understood by now turning to the following drawings, wherein like elements are referenced by like numerals.

Figure 1:
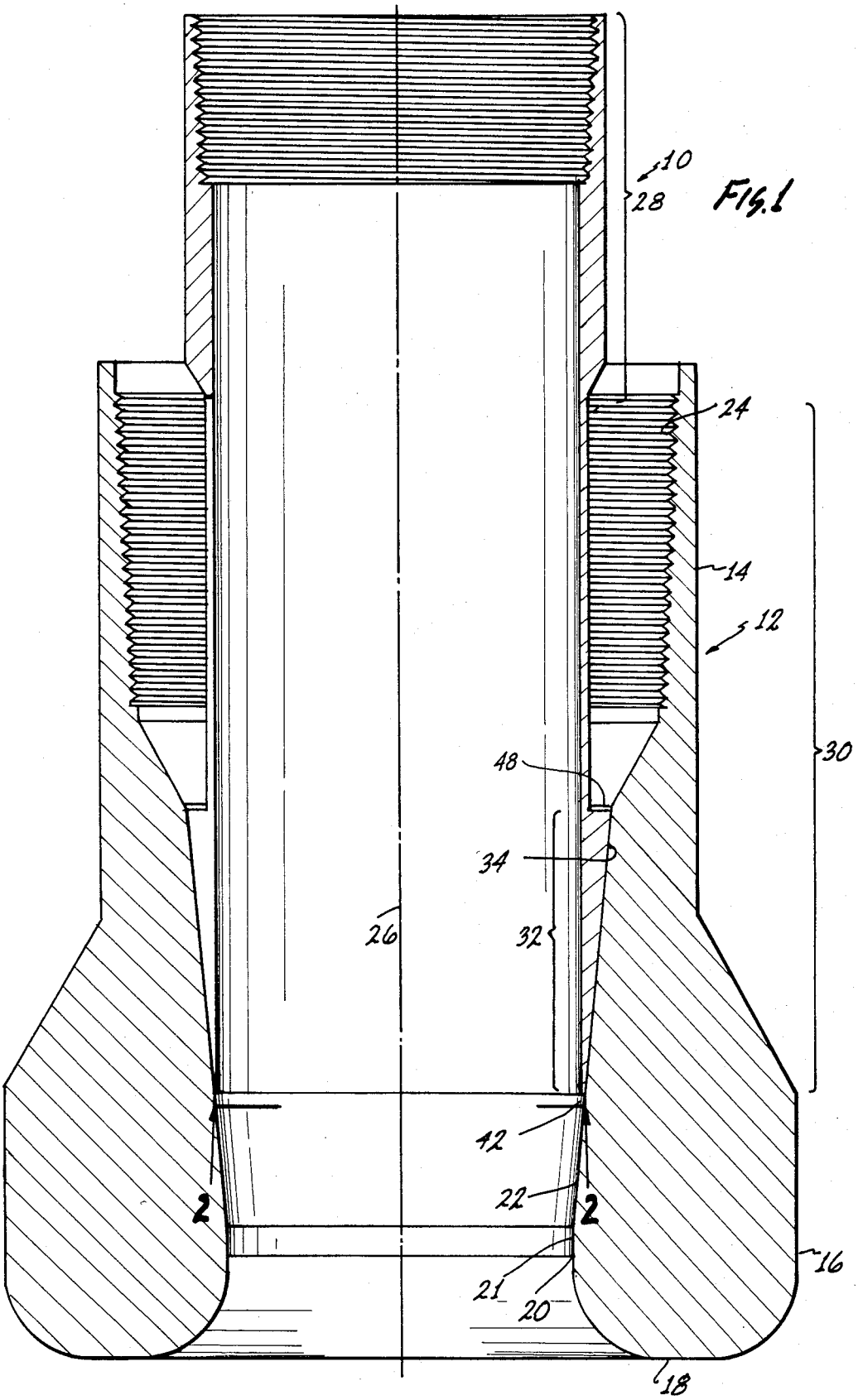
FIG. 1 is a cross-sectional view of a core catcher of the invention shown in combination in contact with a core bit, but in isolation of the remaining components of a coring tool.

FIG. *2a* is a cross-sectional view of a first embodiment of the core catcher taken through line 2—2 of FIG. 1.

FIG. *2b* is a second embodiment of the core catcher taken through line 2—2 of FIG. 1.

FIG. *2c* is a third embodiment of the core catcher taken through line 2—2 of FIG. 1.

FIG. *2d* is a fourth embodiment of the core catcher taken through line 2—2 of FIG. 1.

The present invention and its various embodiments are better understood by now turning to the following detailed description.

DETAILED DESCRIPTION OF THE PREFERRED EMBODIMENTS

The present invention is a collapsible core catcher which is arranged and configured to apply a uniform seizing and retaining force circumferentially about a core. When embodied as a collapsible, reusable core catcher according to the invention, a portion of the core catcher is divided into a plurality of longitudinal sections, each section being defined by adjacent longitudinally extending slots. The lower end of the core catcher thus forms a plurality of resiliently extending fingers, the upper end of the core catcher being a substantially rigid cylindrical section. In one embodiment, the thin slots are generally radial, the direction of the slot lying substantially perpendicular to the surface of the core catcher. In a second embodiment, the thin slots of the reusable core catcher are azimuthally inclined, the slots being inclined at an angle with respect to a radius of the core catcher. When embodied as a nonreusable core catcher, the collapsible core catcher is designed to be irreversibly crushed and compressed against the core. In one embodiment of the nonreusable core catcher, a series of flutes are longitudinally defined along the lower part of the core catcher, thereby leaving an extremely thin core catcher wall at the bottom of the flute. The upper part of the core catcher is, as before, a generally rigid cylindrical section. When the core catcher is forced downwardly during operation, and jammed between the core and the inner surface of the bit or shoe, the thin portions of the embodiment of the flutes of the core catcher are irreversibly crushed, thereby reducing the diameter of the bottom portion of the core catcher and forming a tight interference and crushing fit against the core. Alternatively, another embodiment of the nonreusable core catcher includes a lower portion of the core which is formed entirely of a corrugated thin walled, generally cylindrical segment. The corrugated thin walled section is then crushed as it is jammed tightly against the core, and generally crushes and penetrates the core. One mechanism for hydraulically forcing the inner tube and the core catcher downwardly is shown and described in copending application entitled "Mechanism for Downward Displacement of an Inner Tube to Actuate Various Core Catchers" now issued as U.S. Pat. No. 4,554,613 assigned to the same assignee as the present invention. According to the invention, the core catcher and inner tube can thus be thought of as a single tool element with the core catcher actually forming a terminal extension of the inner tube.

The invention can better be understood by now turning to FIG. 1. FIG. 1 is a simplified cross-sectional view of a core catcher, generally denoted by reference numeral 10, and a coring bit, generally denoted by reference numeral 12. The remaining portions of the drill string, such as the core bit shoe, inner barrel, core barrel sleeves, and the like, have been omitted for the sake of clarity, and are moreover not essential to understanding the present invention. Core bit 12 has thus been shown in idealized form, which should not be read as limiting the scope of the invention. Many other shapes, profiles, and types of core bit may be used other than that shown or implied from the depiction of FIG. 1.

In any case, core bit 12 includes a shank 14, an outer gage 16, a crown 18, an inner gage 20, an internal throat 21, and an internal inclined surface 22. Shank 14 is typically coupled to a core barrel outer tube, not shown, by means of conventional pin and box threading 24. The cutting elements which cut the core to gage and keep the bore hole in gage are typically distributed across inner gage 20, crown 18, and outer gage 16 in a conventional manner. Internal surface 22 is generally a substantially smooth surface which defines a frustoconical shape about longitudinal axis 26 of the drill string and core bit 12.

Core catcher 10 is comprised of an upper body portion 28 and a lower body portion 30. Upper body portion 28 is a generally rigid cylindrical body. Lower portion 30 of core catcher 10 includes at least a lowermost section 32 which includes an inclined surface 34 opposing, and arranged and configured for contact with inclined surface 22 of bit 12. In the preferred embodiment as shown in FIG. 1, inclined surface 34 of lowermost portion 32 core catcher 10 is generally wedge-shaped in cross section and characterized by the same angular inclination with respect to longitudinal axis 26 as surface 22 of bit 12. Therefore, surfaces 34 of core catcher 10 and surface 22 of bit 12 provide a substantially uniformly mating surface of contact, a frustoconical surface, along which core catcher 10 may be relatively longitudinally displaced by an interference fit with the adjacent core (not shown).

To better understand the invention, turn now to the first embodiment of FIG. *2a* which is a sectional view taken through line 2—2 of FIG. 1. Core catcher 10 is characterized in the first embodiment by a lowermost portion 32 which is generally cylindrical in cross section. Lowermost portion 32 is further characterized by a multiplicity of thin slots 36. In the embodiment of FIG. *2a* slots 36 are generally radial so that they are substantially perpendicular to the tangents at the inner and outer surface 34 of core catcher 10. The thickness of lowermost portion 32 is sufficient such that the separate tines 38 defined by multiplicity of slots 36 are generally noncrushable. Therefore, lowermost portion 32 of core catcher 10, as shown in the embodiment of FIG. 2, can be diametrically compressed about the adjacent core by squeezing the corresponding multiplicity of tines 38 inwardly and closing the small gaps created by slots 36. Meanwhile, upper portion 28 of core catcher 10 remains substantially rigid and provides a means for collectively holding and arranging tines 38 of lowermost portion 32 in a generally cylindrical configuration. As depicted in FIG. 1, tines 38 will be tapered toward upper portion 28 of core catcher 10 and will taper to a thinner thickness at the distal or lowermost end of core catcher 10 closest to inner gage 20 of core bit 12.

Figure 2A:
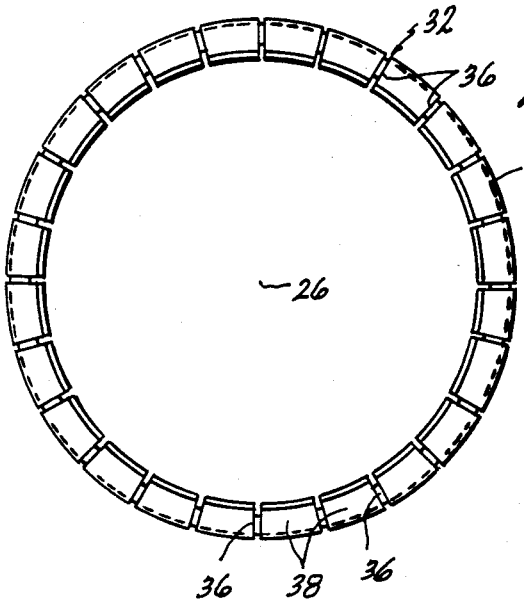
Figure 2B:
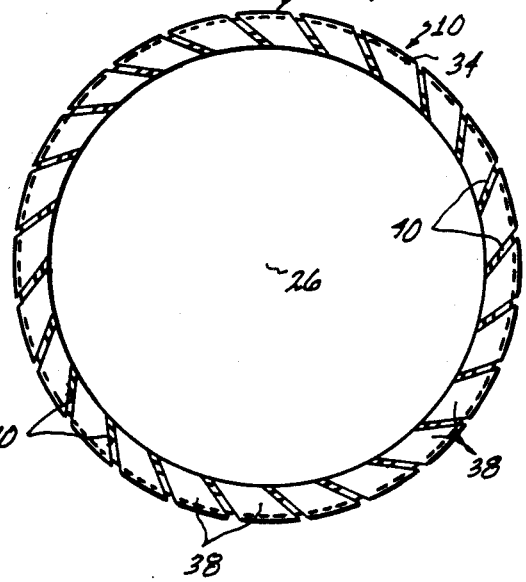

Turn now to the second embodiment of FIG. 2*b* wherein core catcher 10 is again depicted in cross sectional view through lines 2—2 of FIG. 1. In the second embodiment tines 38 are defined by a multiplicity of thin inclined slots 40 defined through the thickness of lowermost portion 32 of core catcher 10. The embodiment of FIG. 2*b* is distinguished from that of FIG. 2*a* in that thin slots 40 are not radially disposed as they are on the first embodiment of FIG. 2*a*, but are at least in part disposed through lowermost portion 32 along a cord of the cylindrical cross section of lowermost portion 32. As before, slots 40 define tines 38 through the entire lower portion 30 of core catcher 10, thereby rendering the lower portion 30 relatively diametrically compressible. In addition, the second embodiment of FIG. 2*b* has a tapered thickness as described in connection with the embodiment of FIG. 2*a* and as best shown in FIG. 1 is tapered throughout lowermost portion 32. The somewhat longe inclined slot 40 as compared to the radial slot 36 of FIG. 2*a* removes more material from lowermost portion 32 of core catcher 10, and therefore proportionally allows a greater degree of volumetric compression of lowermost portion 32.

Figure 2C:
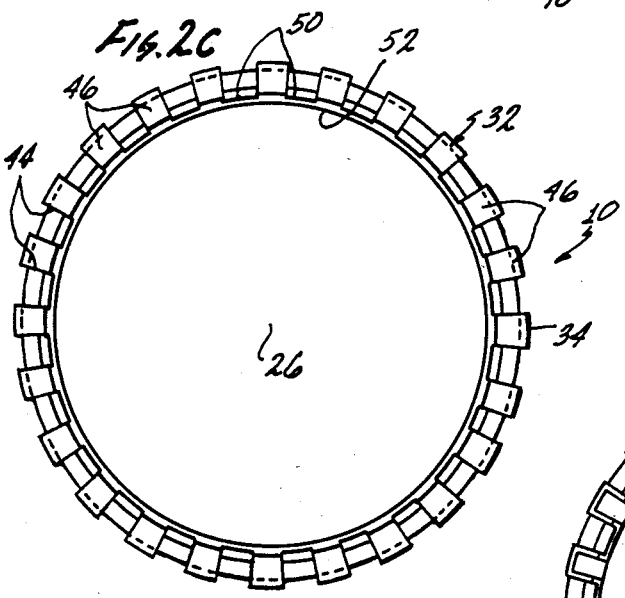
Figure 2D:
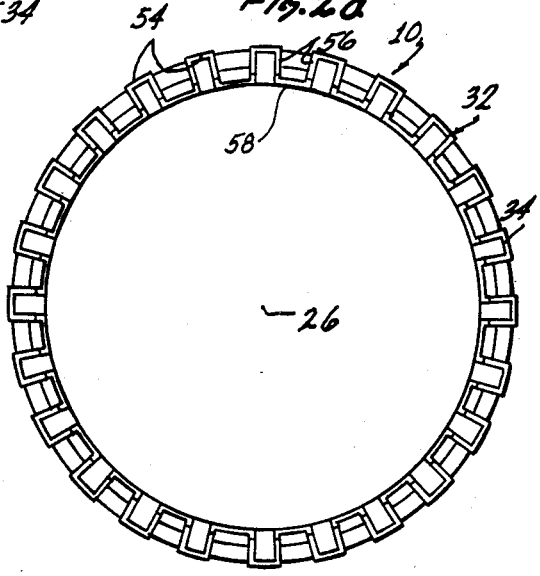

Whereas FIGS. 2*a* and 2*b* are related to a first and second embodiment of the invention respectively, which is reusable, namely reusable in repeated operations without replacing core catcher 10, the third and fourth embodiments of FIGS. 2*c* and 2*d* respectively, are nonreusable. In the embodiments of FIGS. 2*c* and 2*d* the nonreusable core catcher differs again in the design of its lowermost portion 32 and is generally characterized by being irreversibly crushable. The circumference and diameter of the third and fourth embodiments of FIGS. 2*c* and 2*d* can thus be decreased substantially without regard to the design and geometry of lowermost portion 32 of core catcher 10. In other words, the degree of diametric compression of lowermost portion 32 of the third and fourth embodiments of FIGS. 2*c* and 2*d* will in the first approximation, be determined by the compressibility of the adjacent core and the forces applied to jam core catcher 10 between inclined surface 22 and the core, rather than on any geometric design detail of core catcher 10. Therefore, it is contemplated as being within the scope of the invention that the degree of diametric closure of lowermost portion 32 may be complete or nearly complete. In other words, core catcher 10 may be downwardly disposed within core bit 12 by a sufficient longitudinal distance so that as lowermost portion 32 collapses, its free ends 42 will tend to converge to a complete closure. This would, of course, be of great advantage in fragmented, loose and unconsolidated formations which would otherwise tend to run out of the core tube unless positive and full closure was attained.

Consider now the third embodiment by turning to FIG. 2*c* to consider the details of the design. Lowermost portion 32 is comprised of a multiplicity of flutes 44, wherein adjacent flutes define a generally longitudinal rib 46. Again, ribs 46 have a generally uniform tapering thickness beginning at a maximum thickness at edge 48 to the minimal thickness at edge 42. Between ribs 46 and at the bottom of flutes 44 is a thin walled segment 50. The bottom of ribs 46 and thin walled segment 50 are integral and define a generally circular cylindrical interior surface 52.

As core catcher 10 is longitudinally displaced downwardly in inclined surface 22 of bit 12, a uniform circumferential compression is exerted against outward circumferential surface 34 of ribs 46. Thus, ribs 46 are simultaneously compressed toward longitudinal axis 26 and thin circumferential walls 50 begin to wrinkle, bend and crush. In the meantime, lowermost portion 32 of core catcher 10 begins to compress and dig into the adjacent core. Compressibility of the third embodiment of FIG. 2*c* is thus limited only after substantial compression at which point longitudinal ribs 46 are brought into contact or near contact.

Turn now to the fourth embodiment of FIG. 2*d* which is a nonreusable core catcher even more crushable or collapsible than the third embodiment of FIG. 2*c*. Lowermost portion 32 of core catcher 10 of the embodiment of FIG. 2 is comprised of a corrugated thin wall comprising a generally circular cylindrical section. Therefore, a multiplicity of corrugations are formed in the thin wall of lowermost portion 32 to comprise a plurality of fingers 54. In the preferred embodiment of FIG. 2*d* each finger 54 is generally rectangular. The outermost circumferential surface of rectangular finger 54 forms part of outer surface 34 of lowermost portion 32. Sides 56 of each finger 54 extend radially inward to form the radial extension of the corrugation with adjacent fingers being integrally connected by circumferential wall 58 forming the inside surface of lowermost portion 32. Therefore, prior to collapse or crushing, wall 58 will be in or near contact with the core while outer surface 34 is in or near contact with inclined surface 22 of bit 12. As core catcher 10 is then wedged tightly between inclined surface 32 and the core, fingers 54 including interlying circumferential wall segments 58 will wrinkle, crush and collapse as lowermost portion 32 compresses and digs into the adjacent core. Again, the radial extent of fingers 54 as defined by side walls 56 will vary from a maximum from longitudinal point 48 to a minimum at point 42, where as in the third embodiment, the thickness is equal to the minimal wall thickness of core catcher 10.

Thus, it may now be appreciated that whereas the first and second embodiments of FIGS. 2*a* and 2*b* respectively are reusable and noncrushable, since a plurality of tines 38 are defined in lowermost portion 32, the third and fourth embodiments of Figures 2*c* and 2*d* are nonreusable by irreversible crushing and collapse by an amount greater than the designs of FIGS. 2*a* and 2*b*. The degree of compression of the embodiments of FIGS. 2*a* and 2*b* are clearly limited by the slot widths, slots 36 and 40 respectively, since tines 38 are substantially noncrushable. Although the third embodiment of FIG. 2*c* is substantially more compressible than either of the first and second embodiments of the FIGS. 2*a* and 2*b* respectively, the compression of the third embodiment is limited by the thickness of substantially noncrushable ribs 46. On the other hand, the entire lowermost portion 32, of the fourth embodiment of FIG. 2*d* is entirely crushable and full closure in a loose, soft, or unconsolidated core becomes possibile. However, the present invention is generally intended for use with at least semiconsolidated cores and in each case, demonstratively applies a uniformly compressive, retaining force about the core.

Many alterations and modifications may be made by those having ordinary skill in the art without departing from the spirit and scope of the invention. Therefore, it must be clearly understood that the illustrated embodiment is set forth only for the purposes of example and should not be taken as limiting the definition of the invention as set forth in the following claims.

I claim:

1. An improvement in a coring tool having a longitudinal axis including a core catcher, said improvement comprising:

an upper section of said core catcher; and a lower section of said core catcher connected to and extending from said upper section, said lower section including means for collapsing said lower section inwardly toward said longitudinal axis of said coring tool as said core catcher is longitudinally displaced within said coring tool, wherein said means for collapsing said lower section of said core catcher comprises:

a plurality of tines defined in said lower sections, each tine having a tapered thickness beginning with a maximal radial thickness at a first predetermined longitudinal point on said lower section of said core catcher and decreasing to a minimal thickness at a lowermost end of said lower section of said core catcher; and a corresponding adjacent tapered surface within said coring tool, said tines and adjacent surface having a surface of mutual contact describing a frustoconical shape of decreasing diameter toward said lowermost end of said lower section of said core catcher;

wherein said plurality of tines are defined in said lower section of said core catcher by a corresponding plurality of thin inclined slots defined at least, in part through said lower section of said core catcher along a cord of the cross section of said core catcher, said inclined slots extending through said core catcher from said lowermost edge of said lower section of said core catcher to said upper section of said core catcher, whereby a substantially uniform compressive force is exerted by said core catcher against a core disposed within said coring tool.

2. An improvement in a coring tool having a longitudinal axis including a core catcher, said improvement comprising:

an upper section of said core catcher; and a lower section of said core catcher connected to and extending from said upper section, said lower section including means for collapsing said lower section inwardly toward said longitudinal axis of said coring tool as said core catcher is longitudinally displaced within said coring tool, wherein said means for collapsing comprises:

a plurality of longitudinal ribs interconnected by thin integral longitudinally extending wall portions, said ribs and wall portions forming said lower section of said core catcher, said ribs having a tapering thickness beginning with a maximal thickness at a first longitudinal point and decreasing in radial thickness to a lowermost edge of said lower section of said core catcher; and an opposing adjacent tapering internal surface of said coring tool, said plurality of ribs being in contact with said adjacent internal surface and mating therewith, the surface of contact between said ribs and said adjacent internal surface of said coring tool defining a frustoconical shape with a decreasing diameter to said lowermost edge of said lower section of said core catcher whereby a substantially uniform compressive force is exerted by said core catcher against a core disposed within said coring tool.

3. The improvement of claim 2 wherein each said rib is substantially solid and noncrushable.

4. The improvement of said claim 2 wherein each said rib is hollow and crushable.

5. An improvement in a coring tool having a longitudinal axis including a core catcher, said improvement comprising:

an upper section of said core catcher; and a lower section of said core catcher connected to and extending from said upper section, said lower section including means for collapsing said lower section inwardly toward said longitudinal axis of said coring tool as said core catcher is longitudinally displaced within said coring tool, wherein said means for collapsing comprises a thin walled corrugated surface forming said lower section of said core catcher, said corrugations being comprised of a plurality of radially extending fingers, the radial extent of said fingers running from a maximal at a first longitudinal point on said core catcher to a minimal at a lowermost edge of said lower section of said core catcher, and an internal mating and opposing surface of said coring tool, said corrugations forming a surface of contact with said inner surface of said coring tool and defining a frustoconical shape with a decreasing diameter toward said lowermost edge of said lower section of said core catcher whereby a substantially uniform compressive force is exerted by said core catcher against a core disposed within said coring tool.

6. A core catcher for use in a coring tool, said coring tool having an internal frustoconical shaped surface comprising:

an upper cylindrical section longitudinally slideable within said coring tool; and a collapsible lower section integral with said upper section for grasping and providing a substantially uniform circumferential compressive force on said core, said lower section in slideable contact with said internal surface of said coring tool;

wherein said collapsible lower section is comprised of a plurality of resilient segments and is therefore reusable;

wherein said resilient segments comprises a plurality of longitudinally disposed tines, said tines, defined by corresponding plurality of thin slots defined through said lowre section of said core catcher;

wherein said thin slots are slanted and nonradially disposed through said lower section of said core catcher.

7. A core catcher for use in a coring tool, said coring tool having an internal frustoconical shaped surface comprising:

an upper cylindrical section longitudinally slideable within said coring tool; and a collapsible lower section integral with said upper section for grasping and providing a substantially uniform circumferential compressive force on said core, said lower section in slideable contact with said internal surface of said coring tool;

wherein said collapsible lower section is comprised of a permanently deformable wall and is therefore nonreusable.

8. A core catcher for use in a coring tool, said coring tool having an internal frustoconical shaped surface comprising:

an upper cylindrical section longitudinally slideable within said coring tool; and a collapsible lower section integral with said upper section for grasping and providing a substantially uniform circumferential compressive force on said core, said lower section in slideable contact with said internal surface of said coring tool;

wherein said collapsible lower section is comprised of a permanently deformable wall and is therefore nonreusable;

wherein said permanently deformable wall is comprised of a plurality of longitudinally extending ribs interconnected by a thin web.

9. The core catcher of claim 8 wherein said ribs are solid and substantially noncrushable.

10. The core catcher of claim 8 wherein said ribs are hollow and crushable.

11. A core catcher for use in a coring tool, said coring tool having an internal frustoconical shaped surface comprising:

an upper cylindrical section longitudinally slideable within said coring tool; and a collapsible lower section integral with said upper section for grasping and providing a substantially uniform circumferential compressive force on said core, said lower section in slideable contact with said internal surface of said coring tool;

wherein said collapsible lower section is comprised of a permanently deformable wall and is therefore nonreusable;

wherein said permanently deformable wall is comprised of a corrugated web.

12. A method for retaining a core within a coring tool comprising the steps of:

cutting said core;

disposing said cut core within said coring tool;

longitudinally displacing a core catcher within said coring tool without dependence upon gravity and without dependence upon interference fit between said core and core catcher; and permanently structurally collapsing said core catcher by said longitudinal displacement of said core catcher within said coring tool to exert a radially compressive force against said core.

13. A method for retaining a core within a coring tool comprising the steps of:

cutting said core;

disposing said cut core within an inner tube within said coring tool;

displacing said inner tube within said coring tool; and permanently structurally collapsing at least a terminal portion of said inner tube by said longitudinal displacement of said inner tube within said coring tool to exert a radially compressive force against said core.

14. The method of claim 13 wherein said terminal portion of said inner tube is a permanently deformable core catcher, and where said step of longitudinally displacing said inner tube comprises the step of downwardly longitudinally displacing said core catcher within said coring tool independent of an interference fit with said core and independent of gravity.

15. An improvement in a coring tool having an inner tube, said improvement comprising a terminal extension of said inner tube, said terminal extension of said inner tube including means for permanently collapsing at least a portion of said terminal extension radially inward towards said longitudinal axis of said coring tool as said inner tube is longitudinally displaced within said coring tool, whereby a substantially uniform and constant compressive force is exerted by said terminal extension against a core disposed within said coring tool, said terminal extension acting as a core catcher.

* * * * *